US008687066B2

(12) United States Patent
Vaioli

(10) Patent No.: US 8,687,066 B2
(45) Date of Patent: Apr. 1, 2014

(54) PROCESS AND APPARATUS FOR MANAGING SIGNALS AT A BOWLING ALLEY OR THE LIKE

(75) Inventor: Roberto Vaioli, Ozzano Dell' Emilia (IT)

(73) Assignee: Qubicaamf Europe S.p.A, Bologna (IT)

( * ) Notice: Subject to any disclaimer, the term of this patent is extended or adjusted under 35 U.S.C. 154(b) by 547 days.

(21) Appl. No.: 12/664,319

(22) PCT Filed: Jun. 13, 2008

(86) PCT No.: PCT/IB2008/001540

§ 371 (c)(1),
(2), (4) Date: Dec. 11, 2009

(87) PCT Pub. No.: WO2008/152496

PCT Pub. Date: Dec. 18, 2008

(65) Prior Publication Data

US 2010/0134687 A1 Jun. 3, 2010

(30) Foreign Application Priority Data

Jun. 14, 2007 (IT) ..... BO2007A0419

(51) Int. Cl.
*H04N 7/18* (2006.01)
*G06F 3/00* (2006.01)
*G06F 15/167* (2006.01)

(52) U.S. Cl.
USPC ..... 348/157; 715/706; 715/709; 709/213; 709/218

(58) Field of Classification Search
USPC ..... 473/54, 130; 348/23, 14.07, 157, 150; 382/276, 284, 302, 290, 309; 709/213, 709/218; 715/706, 709
See application file for complete search history.

(56) References Cited

U.S. PATENT DOCUMENTS

| | | | | |
|---|---|---|---|---|
| 5,586,238 | A * | 12/1996 | Murata | 345/629 |
| 5,595,389 | A * | 1/1997 | Parulski et al. | 463/31 |
| 6,088,004 | A * | 7/2000 | Domae et al. | 345/1.1 |
| 6,270,421 | B1 * | 8/2001 | Tsujita | 473/54 |
| 6,304,789 | B1 | 10/2001 | Shea | |
| 6,325,725 | B1 * | 12/2001 | Tsujita | 473/70 |
| 6,764,410 | B2 | 7/2004 | Apple et al. | |
| 6,912,432 | B1 | 6/2005 | Shea | |
| 2005/0085272 | A1 * | 4/2005 | Anderson et al. | 455/566 |
| 2005/0089153 | A1 | 4/2005 | Vaioli | |
| 2005/0101397 | A1 * | 5/2005 | Bouchard | 473/54 |
| 2008/0101456 | A1 * | 5/2008 | Ridge et al. | 375/240.01 |
| 2009/0202114 | A1 * | 8/2009 | Morin et al. | 382/118 |
| 2010/0026803 | A1 * | 2/2010 | Yamaguchi et al. | 348/143 |

FOREIGN PATENT DOCUMENTS

| | | |
|---|---|---|
| DE | 103 09 676 | 9/2004 |
| EP | 1 488 832 | 12/2004 |

* cited by examiner

*Primary Examiner* — Joseph Avellino
*Assistant Examiner* — Aftab Nasir Khan
(74) *Attorney, Agent, or Firm* — Andrew M. Calderon; Roberts Mlotkowski Safran & Cole, P.C.

(57) ABSTRACT

In a process and apparatus for managing signals to be broadcast at a bowling alley or the like a video signal comprising an image captured at the bowling alley is displayed at the bowling lane.

26 Claims, 10 Drawing Sheets

PROCESS AND APPARATUS FOR MANAGING SIGNALS AT A BOWLING ALLEY OR THE LIKE

TECHNICAL FIELD

The present invention relates to a process and an apparatus for managing signals at a bowling alley or the like.

BACKGROUND ART

In the bowling field it is known, in particular from patent U.S. Pat. No. 6,764,410, that television signals, internet images and video signals corresponding to a video game are broadcast at the monitor of the respective lane. The purpose of this is to provide additional entertainment for players waiting their turn to play, or to better entertain children who accompany players.

The prior document U.S. Pat. No. 6,764,410 also teaches the use of means at the lane control console for manually selecting the video signal, and in particular for selecting a specific television signal, to be broadcast at the lane monitor. However, such a type of video broadcast at the lane is in itself impersonal and detached from bowling alley users, who limit themselves to use of said additional functions, as if they were at home, without there being a specific connection with the activities of the bowling alley.

According to another aspect, it is also known from document US2005/0101397 that customized light signals are emitted at the lane when a particular game event occurs, for example when someone records a strike. This type of operation, as well as being very popular with bowling alley users, allows the rapid and immediate indication of the game event to all players and spectators, but it does not provide immediate information about the player, or the team, who produced the game event.

It is also known that at the lane monitors an animated cartoon image or the like is broadcast when a certain game event occurs, in particular when someone records a strike. However, such a video signal does not allow immediate information about the player, or the team, who produced the event.

It is also known that at bowling alleys, the photographic and static image of a person, normally a child, whose birthday party has been organized at the bowling alley is captured and displayed on the monitors, to make the theme even more personal. Said static image of the person, including the face and torso, is applied to a default static image. In this case, the image broadcast is not particularly appreciated by users, since there is a low level of integration between the image of the person and the background on which it is applied. Moreover, the image is not in any way connected to any specific event and, in particular is not related to any game event.

However, in general, in the bowling field, there is a strongly felt need to provide users with additional and better functions, which satisfy their specific entertainment, information or other requirements.

In particular, in the bowling field, the need is felt to make available to users information which is rapidly and easily discernible and, also, to provide improved user entertainment at bowling alleys, in particular at the bowling lanes.

DISCLOSURE OF THE INVENTION

According to an advantageous aspect, a process is provided for managing signals at a bowling centre or the like, where a signal is broadcast, which comprises a video signal including an image of a person, the process being characterized in that said image is broadcast when a predetermined event occurs and comprises the image of a person connected with the event that has occurred.

In this way, at bowling alleys it is possible to provide rapidly and easily discernible information, in particular for the public and players, relating to an event that has occurred and the person featured in the event.

BRIEF DESCRIPTION OF THE DRAWINGS

These and other characteristics of the process and apparatus are clearly described in the claims below and the advantages are more apparent from the detailed description which follows, with reference to the accompanying drawings which illustrate preferred embodiments provided merely by way of example without restricting the scope of the inventive concept, and in which:

DETAILED DESCRIPTION OF THE PREFERRED EMBODIMENTS OF THE INVENTION

Figure 1:
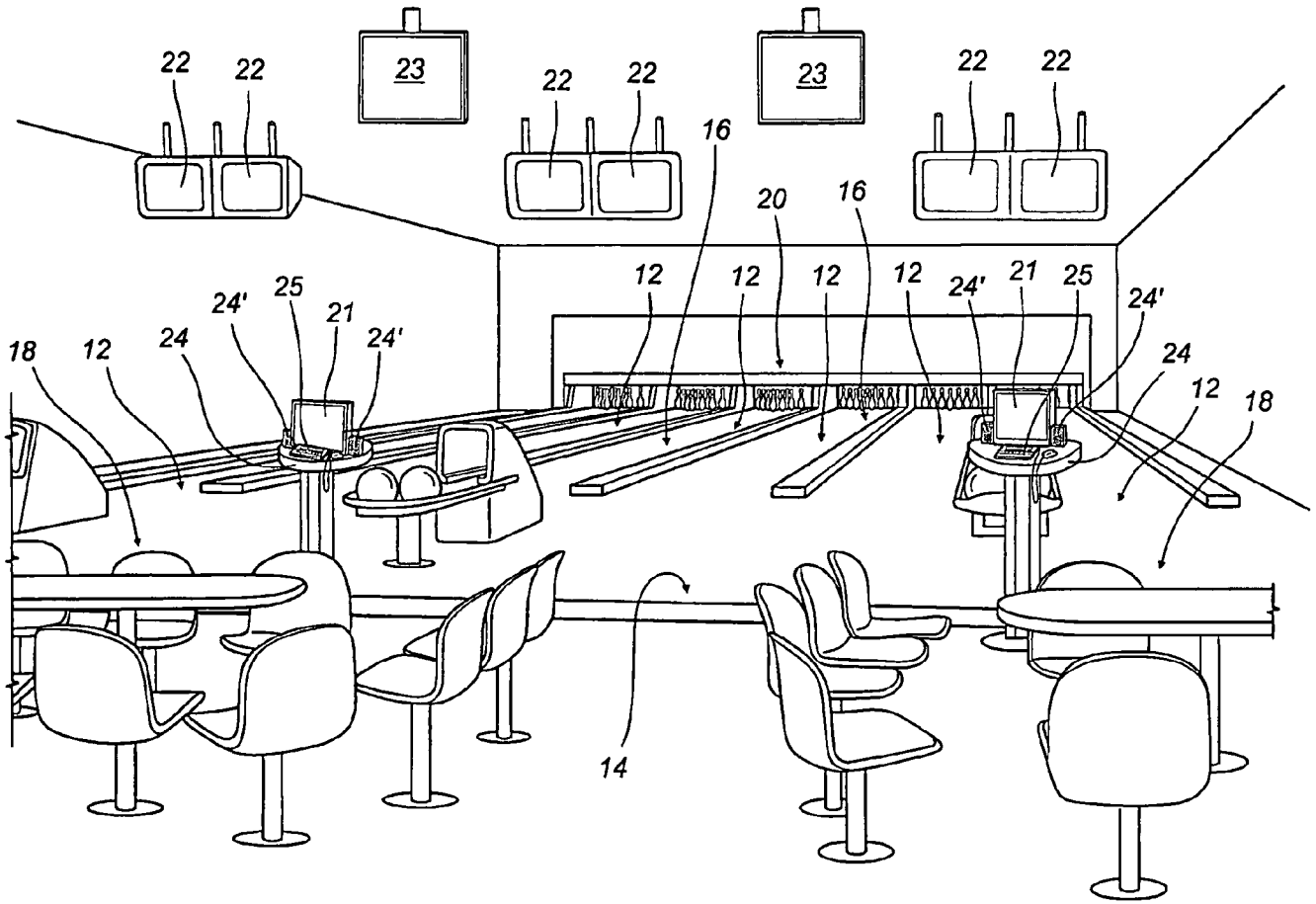
FIG. 1 is a perspective schematic view of a bowling alley.

As is schematically illustrated in FIG. 1, a bowling alley or bowling centre comprises a plurality of lanes 12, having respective first and second ends 14, 16, and, for each lane, a player point 18, located at an upstream end 14 of the lane 12, and a machine for arranging pins, or pin setter, 20, located at a downstream end 16 of the lane 12.

Figure 2:
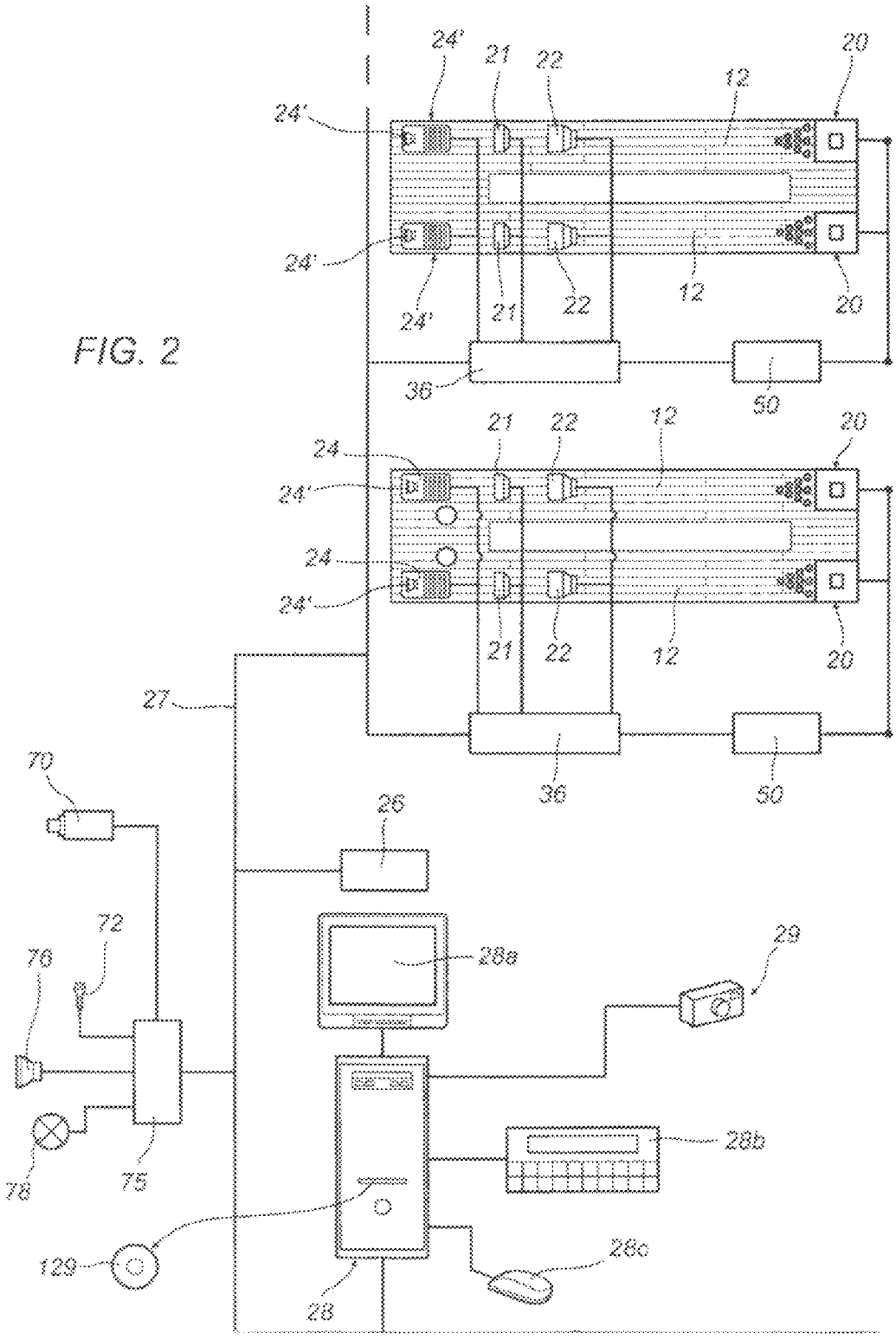
FIG. 2 is a schematic block diagram representing the bowling alley and the system for controlling signals to be broadcast at the lane.

A preferred embodiment of the apparatus or system for managing the signals of a bowling centre or bowling alley is illustrated in detail in FIGS. 1 and 2

The apparatus or system comprises display means at the respective lane, comprising at least a display or monitor 21 at the player point or associated with the SCORING CONSOLE, described below, and a display or monitor 22 in a raised position, called the "overhead monitor" in the jargon of the trade.

These lane monitors are normally used to display the scoreboard.

The apparatus also comprises general display means 23, in the form of display units or monitors, which broadcast corresponding video signals and which are not normally dedicated to broadcasting data and/or signals relating to a specific activity performed or to a respective request made at a specific lane.

The apparatus also comprises means 24 with which users can enter commands, called the "SCORING CONSOLE" in the field, at a player point. Said user command input means located at the player point may comprise a special keyboard or keypad 25, as illustrated in FIG. 1, or a joystick or any other type of device suitable for the purpose.

According to another embodiment, the command input means may also comprise a "touch screen".

Figure 3:
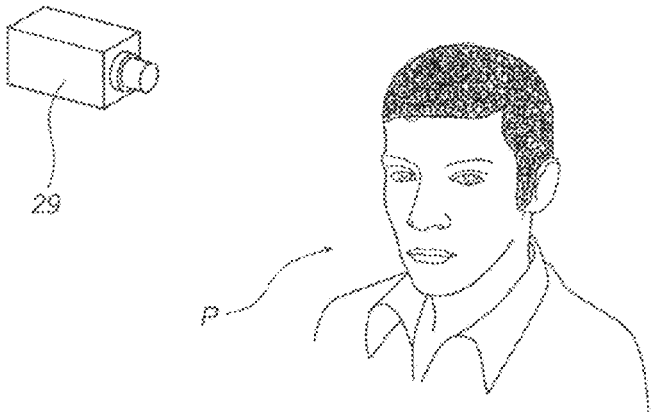
FIG. 3 is a perspective schematic view representing a first method of capturing the image to be broadcast at the bowling alley in accordance with a first embodiment of the present invention.

The apparatus also comprises general or central control or management means, in the form of a main server 26. These general management means, as is clearly shown in FIG. 3, comprise at least a processor, or CPU, a respective memory and means for input into or output from local communication means such as a local area network, for example an Ethernet network 27.

The general management means 26 may also comprise display means, for example in the form of a respective display unit, at the central point or FRONT DESK of the bowling centre. The FRONT DESK is the conventional point at the player reception desk. The display means at the FRONT DESK may comprise, in particular, a corresponding display or monitor, and are not illustrated in detail in the accompanying drawings.

The general management means 26 may also comprise data input means, consisting of the input means at the central point or FRONT DESK. These data input means may comprise, for example, a keyboard or other input device, and are not illustrated in detail in the accompanying drawings.

The present apparatus for managing the bowling alley also comprises respective local control or lane management means, or if necessary means for managing a plurality of lanes, in particular a pair of lanes.

Said local management or control means comprise a processor 36, usually referred to as the SCORE processor in the jargon of the trade.

In particular, the local management or control means, or "SCORE processor", comprise at least a CPU, a respective memory and means for input into or output from a local area network 27, which in particular allows communication with the bowling alley general management or control means 26.

In addition, the local management or control means 36 comprise special input/output means for connection to the display means or monitors 21, 22, at the player point, to the console 24 at the player point, and to the pin setter, or to means 50 for interfacing with the pin setter.

Said general control means 26 and local or lane control means 36 comprise a respective program having a plurality of routines, with respective instructions, suitable for forming corresponding unit 26 and 36 operating means, that is to say, which implement respective management or control functions, provided by them.

In particular, in bowling alleys, the lane management means 36 can detect when certain events occur partly thanks to the presence of suitable sensors, or similar means, located at the respective lane and/or at the pin setter.

More specifically, the signal management apparatus comprises a program, in particular a program residing in the lane control means 36, for managing the SCORE and having respective means, in the form of routines or instructions which detect game-related actions for each specific player, such as for example, a throw resulting in a number of pins being bowled down and convert each action into a corresponding game event, determining for example the type of event, be it a strike or other result and calculating its score and the total game score. The program of the apparatus also comprises means in the form of routines or instructions for displaying the score on respective display means, typically display means at the lane, as mentioned above.

As indicated, communication between the various units of the bowling alley is preferably provided via an Ethernet network. However, it shall be understood that other means of communication could also be used, such as an optical fibre network or communication via Hertz waves or other means.

It shall also be understood that the local control means 36 and/or the general control means 26 of the bowling centre may also be in communication with the Internet or like network or with other bowling centres through the Internet or any other type of specific connection.

In an advantageous process for managing signals to be broadcast at a bowling alley or the like when a predetermined event occurs, a signal is broadcast which comprises a video signal including the image of a person connected or in any way related with the event that has occurred.

More specifically, the predetermined event is an occasional event that occurs while the person is performing an activity in the bowling centre, in particular a game activity, for example a game, a tournament or a championship. Preferably, the predetermined event is caused or produced by a game-related action or occurrence, or arises out of a game activity, that is to say, is related to a player while, in particular while playing at a respective lane.

For this purpose, the apparatus comprises respective control means which, in response to the occurrence of a predetermined event, cause a signal to be broadcast which includes the image of a person related with that event.

More specifically, the apparatus comprises respective means, in the form of routines or instructions, which detect the occurrence of a predetermined event and cause a signal to be broadcast which includes the image of a person related or in any way connected with that event. Preferably, the image displayed corresponds to the person who directly caused or produced the predetermined event.

In particular, as will become clearer as this description continues, it is contemplated a plurality of predetermined events that can cause the signal including the image of the person to be broadcast.

Further, as explained in more detail below, it is contemplated a plurality of signals, each having a respective and different image including the image of the person, said signals being broadcast even upon occurrence of a single predetermined event.

According to an advantageous aspect of the present process, the predetermined event relates to a bowling game activity and, in particular, corresponds to one or more of the following events: a game victory, a tournament victory, a championship victory, a predetermined score, a strike, a spare, a turkey, a perfect game, a foul, a win at Red Pin, a win at Poker. These predetermined events are described in more detail below.

According to another advantageous aspect of the process, the predetermined event relates to a game at the bowling centre and comprises one or more of the following events (described in more detail below and known as Sledge Hammer and Pogo Pin): a random lane selection made by the general control means of the bowling alley, a random lane selection made by the general management means of the bowling alley, accompanied by a strike recorded by a player at the lane, and any other events.

Advantageously, according to one aspect of the process, the image broadcast includes not only the image of the person but also illustrations and/or alphanumeric characters describing the predetermined event, such as, for example, a strike, a certain score and the other events mentioned above or still other events not mentioned above.

According to a further aspect of this process, the signal including the image can also be broadcast upon the occurrence of a special occasion and comprises the image of a person connected or in any way related with that special occasion.

In practice, the image broadcast includes not only the image of the person but also illustrations and/or alphanumeric characters describing or providing a figurative representation of the special occasion concerned, which might be, for example, a birthday, a company party, or any other occasion.

For this purpose, the apparatus comprises control means which, in response to the detection of a special occasion, cause a signal to be broadcast which includes the image of a person related with that special occasion.

More specifically, the apparatus comprises respective means, in the form of routines or instructions, which associate the image of the person with at least one basic image that illustrates or corresponds to a specific occasion and which, upon receiving a respective activation signal, cause a signal to be broadcast which includes the image of a person and a figurative representation of the occasion concerned.

In this way, at bowling alleys or centres it is possible to provide rapidly and easily discernible information, in particular for the public and players, relating to an event that has occurred, in particular a game event, and the person featured in the event.

Further, as will become clearer as this description continues, the information is given in a cheerful and fun way thanks to the representation of the specific event, thereby providing entertainment to delight the users of the bowling centre.

More specifically, the games played at a bowling centre include a traditional bowling game where each player has 10 rounds (or frames) and within each frame is allowed two throws to knock the pins down. Scoring is based on summing the pins knocked down during the player's round.

In particular, during a game, the following predetermined or occasional events might occur.

A first predetermined or occasional event might consist of a victory in a specific game, championship or tournament or simply reaching a predetermined score.

Another predetermined or occasional event might be a Strike, where, as is known, a player knocks down all ten pins with the first ball thrown in their frame.

Another predetermined or occasional event might be a Spare where the player bowls down all ten pins using both the balls available in their frame. A Spare is quite a common event during a game and may be considered as the result of two or more related actions or occurrences within a game or match (for example, it occurs when the ball is rolled twice and bowls down 5 pins each time).

Another predetermined or occasional event might be a Turkey, that is to say, three consecutive Strikes.

Another example of a predetermined or occasional event is a Perfect Game, that is to say, a set of twelve consecutive Strikes in one game. In this case, the player scores the highest number of points possible in one game, that is, 300 points. A player may also reach a maximum of 12 frames if they record a Strike or a Spare in the tenth frame. The additional frames are necessary because the score assigned to a Strike is calculated taking into account the points scored in the next two frames.

Yet another example of a predetermined or occasional event is a Foul, that is to say a penalty incurred when the player's foot crosses the foul line that separates the lane from the approach area, that is to say, the area in which the player must be when the ball is rolled. A foul counts zero for the throw in which it occurs, regardless of how many pins are knocked down.

A still further predetermined or occasional event might be a fun game specific to the bowling centre, that is to say, a game based on the points scored during a game but "outside" the official rules of the game. In this case, a win would not increase or otherwise change the score but would entitle the winning player to a prize provided by the bowling centre or tournament organizers. Games of this kind may be based on skill, or on pure luck when the winner is selected regardless of the score, or on a combination of both when a player is required to score a predetermined number of points at a specified time.

One example of a fun game might be the game known as Red Pin. In this game, the set of pins on the pin deck includes a red pin. The predetermined or occasional event might occur if the player records a strike when the red pin is in position one, that is to say, when it is at the tip of the set, nearest the player.

Another fun game often played at bowling centres is Poker, incorporating the card game and where a player receives a card each time they record a strike or a spare, up to a maximum of five cards. Also, for every strike or spare after the fifth, the player can change a card. In this case, the predetermined or occasional event might be a win at this game, awarded to the player with the best "hand", according to the rules of the card came of poker, at the end of the game.

Another fun game is known as Pogo Pin. In this game, an animated object appears on the lane monitors and jumps from one monitor to another until it stops at a lane selected at random by the system or predetermined by the staff of the bowling centre. The prize goes to the player active at the moment the object stops at the selected lane. In this case, the predetermined or occasional event is defined by the "active" condition of the respective lane.

Yet another fun game is known as Sledge Hammer. In this game, an animated object appears at a lane selected at random by the system. The prize is awarded to the player active at that moment if they record a strike or a minimum specified score. In this case, the predetermined or occasional event is defined by the strike or specified score recorded at the "activated" lane.

Advantageously, in the process, the signal including the image of the person is broadcast automatically when a predetermined event occurs.

In particular, according to this process, the occurrence of this predetermined event is also determined automatically.

In practice, the apparatus comprises means, in the form of a program with respective routines or instructions, which determines the predetermined events, upon the occurrence of which a corresponding signal with the image of the person is broadcast, based on the data determined by the normal game score control program or on the signals detected at the lane or at the lane pin setter.

In practice, means are thus provided for automatically detecting the predetermined event that triggers the broadcasting of the signal including the image of the person.

The apparatus also comprises means, in the form of a program with respective routines or instructions, which are designed to automatically broadcast the signal including the image of the person upon the occurrence of a predetermined event.

According to the process, the signal including the image of the person is broadcast in connection with a player, in particular a bowler playing at a respective lane.

The lane control means of processor 36 or, if necessary, the general control means or server 26 automatically determine the predetermined event and automatically broadcast the signal including the image corresponding to the person or player.

According to another aspect, the image broadcast at the bowling centre or bowling alley is captured at the bowling centre itself. Alternatively, a user might connect up to the bowling centre's web site from home or from any other Internet access point outside the specific kiosk at the bowling centre and provide their image and data in the same way.

It shall be understood that, in the context of this description, the term image of the person means not only, though preferably, a static image, as illustrated below, but also an animated image or even a sequence of static images.

For this purpose, in a preferred embodiment of it, the apparatus comprises means 28, 29 for generating a video signal to be displayed at the lane display means 21, 22.

In particular, the signal generator comprises means 29, located in the same bowling alley where the game is played, for capturing an image of the person, as is explained in more detail as this description continues.

The means for displaying the image of the person are preferably displays or monitors 21, 22 which are used to display the game SCORE, at the respective lane in the bowling alley. It shall be understood, however, that the image of the person might also be displayed at the bowling centre's general display means 23.

According to the process, advantageously, the image of the person corresponds to that of a player P, in particular being an image of the player's face. However, according to an alternative embodiment, it is also possible that the image of another person, who is not specifically a player, may be captured.

Figure 4:
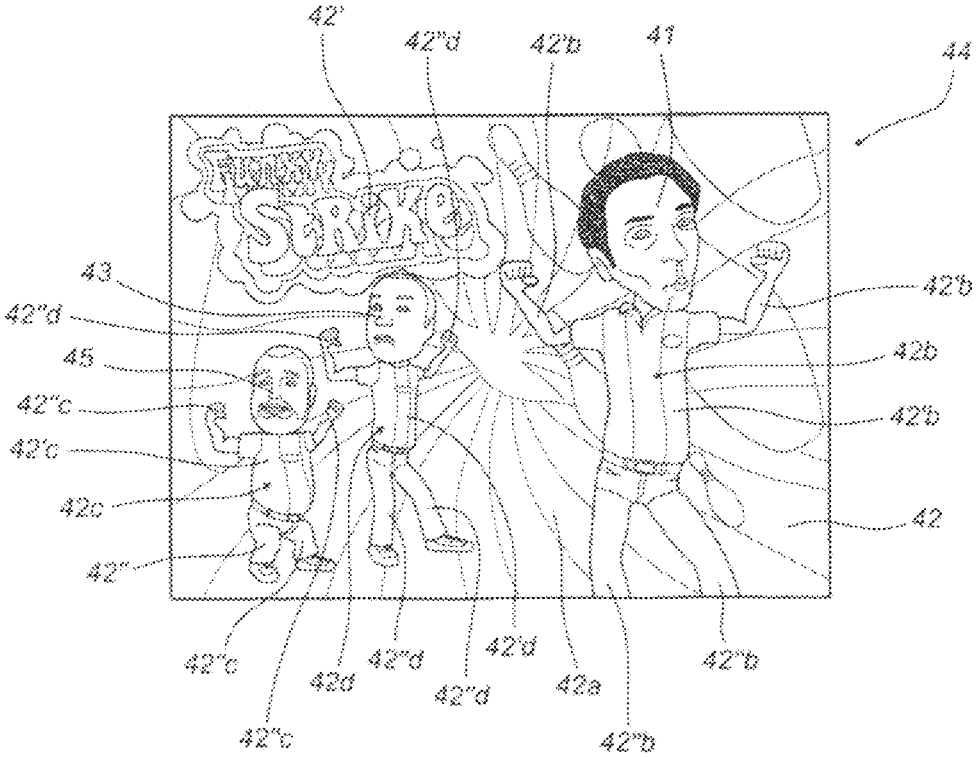
FIG. 4 is a video image to be broadcast at the lane according to the first preferred embodiment of the present invention.

According to the process, as may be inferred from FIG. 4, said broadcast video signal is advantageously in the form of a combined image 44 comprising an image of a person 41 and a basic image 42.

In particular, as illustrated in FIG. 4, the broadcast video signal or combined image 44 comprises a plurality of images of persons 41, 43, 45, combined with a respective basic image 42. Said images 41, 43, 45 are images of respective players. In practice, the combined image comprises a plurality of images of persons. The combined image thus created is a fun way of addressing information about the event to the persons featured in the event and even, where required, about the special occasion connected with the persons.

The image generating means comprise respective processing means, or a processor 28, dedicated to that purpose and comprising display means in the form of a screen or monitor 28*a*, and means for entering commands, for example a keyboard 28*b* and a mouse 28*c*. In the bowling alley, the signal generating means 28, 28*a*, 28*b*, 28*c*, 29 may be configured to form a kiosk or separate point which can be freely and independently used by users, in particular by players.

The processing means 28 are suitably connected to the image capturing means 29 and receive as input the signals captured by the capturing means 29.

The processing means or processor 28 are connected to the other units in the bowling alley, preferably through the local area network 27, and are managed through a corresponding program, which resides in the memory of the means 28 and which has respective instructions constituting means for implementing the functions of the generating means described herein.

More specifically, the basic image 42 is, appropriately, saved in the memory of the basic image generating means and, in particular, there is a plurality of basic images saved in the memory of the generating means 28, as described in more detail below.

The image generating means 28 allow the selection, preferably automatic, of the basic image 42 to be associated with the image captured, that is to say the image of the person 41, or a plurality of images captured, or images of persons, so as to obtain a corresponding desired combined image 44. Alternatively, the basic image to be combined might also be selected manually using the input means 28*b*, 28*c* or other means.

Figure 7:
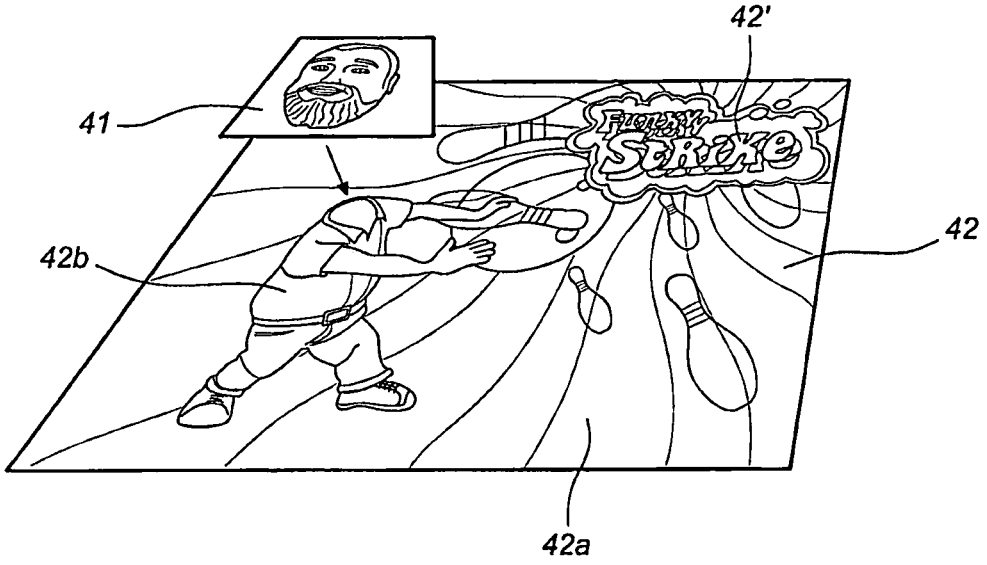
FIG. 7 is a schematic view of the operation for combining the image of the person with a basic image.

The processor 28 for generating or processing the video image to be broadcast at the lane may, in particular, be a PC, having a CPU, a memory, input and output means and a program for generating the image to be broadcast at the lane, comprising instructions or routines, forming means designed to allow association of the desired basic image 42 with the image of the person 41, in particular with the image captured at the bowling alley, and, as illustrated in FIG. 7, in particular they are designed to combine a plurality of images captured, or images of persons 41, 43, 45 with a respective basic image.

Figure 6:
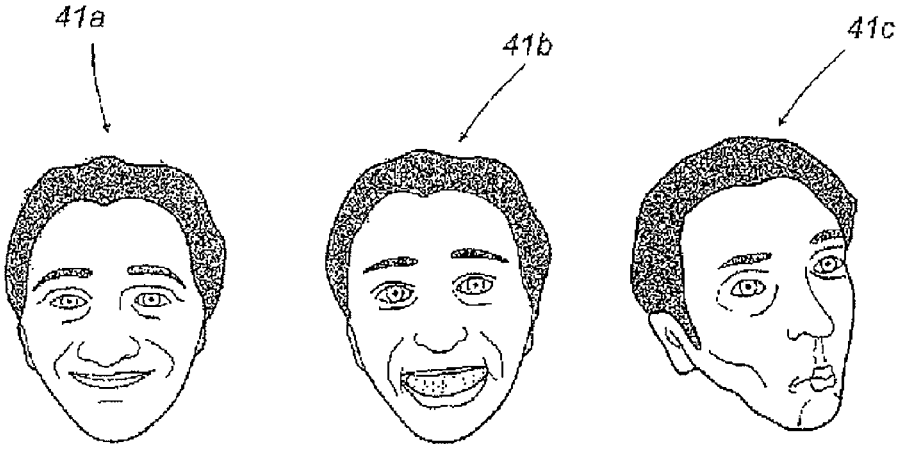
FIG. 6 shows a plurality of images of the person.

According to the process, a plurality of images of a single person are captured. The most suitable images are selected from these images, obtaining a plurality or a set of predetermined images of the person, as illustrated in FIG. 6. The predetermined images correspond to the person's different facial expressions.

In practice, said images, labelled 41*a*, 41*b*, 41*c*, are selected in such a way that they correspond to a predetermined state of the person, in particular a mood and so intend to simulate a respective mood of the person to be represented on screen.

For example, as illustrated, images of the person may be obtained which show a smiling expression 41*a*, a surprised expression 41*b* and a sad expression 41*c*.

According to the process, the means 28*b* and 28*c* are also used to obtain data identifying the person and data about specific characteristics of the person.

In particular, said data about specific characteristics of the person may comprise one or more of the following data items: gender, age and role. Thus, the image to be displayed corresponds to the characteristics of the specific person.

The images of the person, the identification data and the data about the characteristics of the person may be associated with one another and if necessary saved in a memory in the image generating means 28, or in another memory forming part of the apparatus, thus obtaining a file on the single person.

Figure 12:
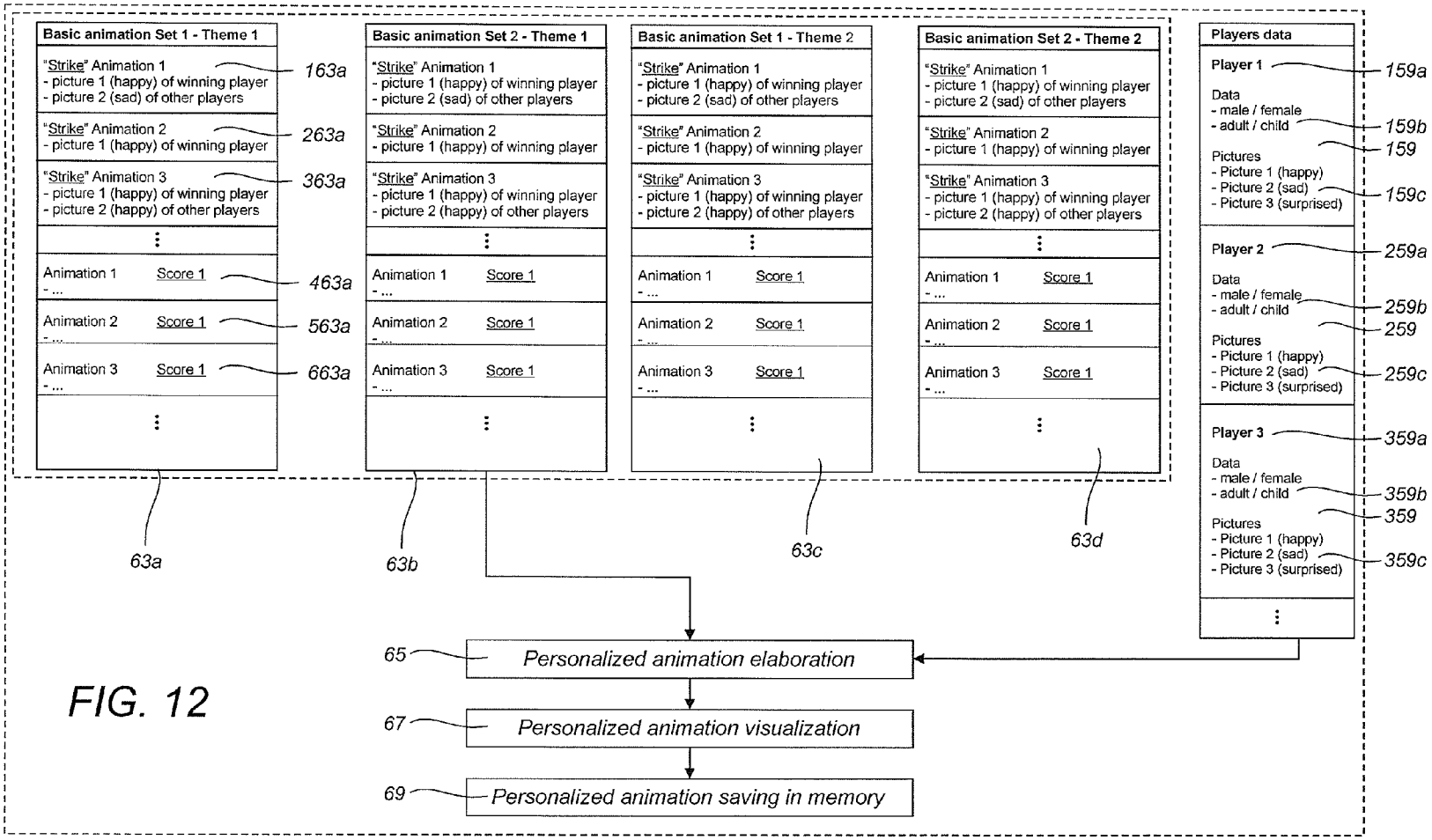

In practice, as shown in FIG. 12, the data and images relating to the persons in some way connected with each other, such as for example, persons playing in the same game, tournament or championship and who will, for example, be combined in a respective combined image, are entered one after another and stored in a respective file.

In practice, the identification data 159*a* of a first person, the data 159*b* relating to the characteristics of that person, and images 159*c* of the person are entered in 159.

Further, the identification data 259*a* of a second person, the data 259*b* relating to the characteristics of that person, and images 259*c* of the person are entered in 259.

Moreover, the identification data 359*a* of a third person, the data 359*b* relating to the characteristics of that person, and images 259*c* of the person are entered in 359. The operation is then repeated for any other persons involved in the game, tournament, championship or other relationship.

According to the process, data identifying the specific theme or occasion is also entered. Said data is preferably entered using the keyboard 28*b*, or with the mouse 28*c*, and involves the use of corresponding input screens or screen pages at the monitor 28*a*.

It is thus possible to automatically select a theme, or set of respective basic images to be associated with the image of the person or corresponding to a specific occasion.

Alternatively, the theme, or set of basic images—which might represent a specific occasion—to be associated with the person might be selected manually using the input means 28*b*, 28*c*, or other means, in particular when the images are captured and the person doing so can choose the specific theme or set of basic images and display them on the display 28*a*.

According to a preferred process, the data entered in this way allows the set of basic images to be selected automatically or manually and to combine them with the respective images of the players.

As illustrated in particular in FIG. 4, according to the present preferred process, the basic image comprises component portions 42*a*, 42*b*, 42*c*, 42*d*, for example comprising a background 42*a*, consisting of a respective illustration or suitably stylized representation, and one or more characters or representations 42*b*, 42*c*, 42*d* relating to a respective person, for example corresponding to a stylized figure, in this particular case representing the body of a player or other stylized image.

The background and character define a respective theme, which might also directly or indirectly represent or be reminiscent of a specific occasion, such as, for example, a birthday, in which case the background image might include appropriate words and illustrations.

In practice, the specific theme, or specific occasion (birthday, company party and so on) can be defined by one or more basic default images.

Advantageously, the portion of the image 42 forming the character is in the form of an animated or partially animated image.

In particular, the portion of the image 42 forming the character, in particular the stylized body, may comprise a fixed part 42'*b*, 42'*c*, 42'*d*, for example the torso of the character, and an animated part 42"*b*, 42"*c*, 42"*d*, for example the arms and/or legs of the character.

The image of the person, in particular only their face, is applied close to or at the respective portion or character, as shown by way of example in the drawing, to obtain a customized image which has significant impact on users.

As shown, the basic image may also comprise an alphanumeric string 42' indicating a corresponding event or other situation.

The process contemplates a plurality of basic default images composed of different component portions.

According to the present preferred process, a respective plurality of basic images 63*a*, 63*b*, 63*c* 63*d* is associated with or corresponds to a respective theme or occasion.

In practice, there are different pluralities of basic default images 63*a*, 63*b*, 63*c*, 63*d* matching each other and forming a respective theme. In practice, the images in the respective pluralities of default basic images have in common at least one graphic or significant element identifying a respective theme.

In particular, as illustrated in FIG. 12, according to the present preferred process, there are different sets of basic images 63*a*, 63*b* corresponding to a first theme and matching sets of basic images 63*c*, 63*d* corresponding to a second theme.

For other themes, respective sets of basic images may be provided.

It shall be understood that in accordance with the present preferred process, there is no limit to the number of themes which may be created and to the number of sets of basic images corresponding to a specific theme.

Therefore, in practice, according to the present preferred process there are respective pluralities of default images 63*a*, 63*b*, 63*c*, 63*d* which are associated with or correspond to respective themes.

Moreover, according to the present preferred process, for each theme there are therefore respective pluralities of default images 63*a*, 63*b* or 63*c*, 63*d*.

For that purpose, each set of basic images 63*a*, 63*b* or 63*c*, 63*d* for the specific theme contains respective images suitably selected to illustrate the specific event or the specific occasion.

In particular, in accordance with a preferred procedure, a respective plurality of default images 63*a*, 63*b* or 63*c*, 63*d* corresponds to a respective theme and relates to a corresponding characteristic of the person.

In such a case, each set of basic images 63*a*, 63*b* or 63*c*, 63*d* contains images selected in connection with the specific theme desired and, if necessary, to the specific occasion illustrated and in connection with the characteristics such as gender, age, role of the person with which they will be associated. In practice, in this case, the set of basic images to be combined with the faces of the persons selected is that which corresponds to the particular theme, to the gender, age, role or other aspect of the person to be displayed.

Moreover, according to the present preferred process, each basic image of the respective plurality of basic images is associated with a corresponding predetermined event.

Preferably, according to the present preferred process, multiple basic images of the respective plurality of basic images are associated with the same predetermined event.

For example, the basic images 163*a*, 263*a*, 363*a* of the set 63*a* of basic images, which are different to one another, correspond to a single same game event, that is to say, they correspond to a strike. Moreover, the basic images 463*a*, 563*a*, 663*a* of the set 63*a* of basic images, which are different to one another, correspond to a single game event, that is to say, they correspond to a throw which produced a score "1". A similar situation applies for other game events, in particular for other scores produced by the player's throw and for other sets 63*b*, 63*c*, 63*d* and so on of basic images.

According to the present preferred process, to obtain the combined image, a predetermined image 41*a*, 41*b*, 41*c* of the person is associated with each basic image. For example, the happy image 41*a* of a player and the sad images of other players are associated with the basic image 163*a*, whilst the happy image 41*a* of a player is associated with the basic image 263*a*, and the happy image 41*a* of a player and the happy images of other players are associated with the basic image 363*a*. The rules for combining the respective images of the person and the basic images are therefore predetermined by the program for generating the combined images.

In this way, a set of combined images 44 is obtained which can be used according to the situations and which are suitably selected by the means or program for controlling the broadcasting of the images, as described in more detail below.

According to the embodiment illustrated, in the combined image 44, the image captured 41 is preferably a fixed or static image, whilst the basic image 42 is an animation, that is to say, it comprises at least some portions which are animated, as already indicated.

In this way, a combined signal 44 is obtained which can be displayed, in particular at the lane, and which is in the form of an animation containing the image of the face of the player or players in a static condition. A combined image is obtained, which is not difficult for the electronic processing means to handle, giving the advantage of low cost and feasible implementation of this process in any apparatus, including existing apparatus, for controlling the signals of a bowling alley or bowling centre.

The means for capturing the image of the person are in particular in the form of a stills camera 29. However, other means may be used, for example a video camera.

As illustrated in particular in FIG. 4, the combined image 44 comprises a display hierarchy of the images captured.

In particular, the image of one of the players is enlarged, or placed in the foreground, whilst the image of the other players 43, 45 is made smaller, or placed in the background. For this purpose, the characters with whom the images are associated are created in such a way as to illustrate or exemplify this hierarchy, that is to say, they are created in different sizes to one another, the character of the player to whom the image refers, that is to say the person directly linked to the game event being larger.

Said image 44 is preferably associated with a respective player, in particular the player in the foreground 41, who performed a predetermined play action, as described in more detail below and also contains the image 43, 45 of persons, or other players, linked to the featured player.

Figure 5:
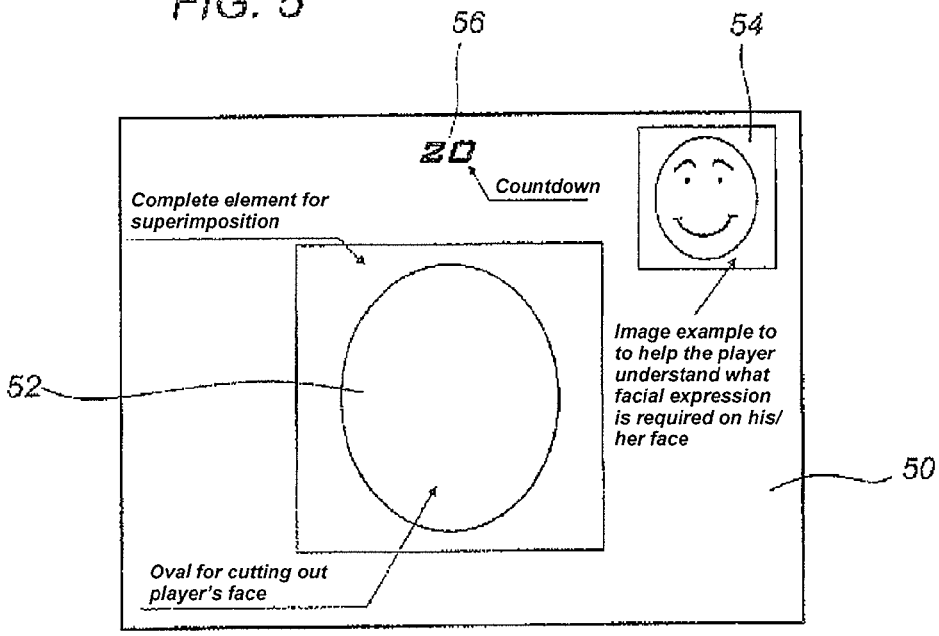
FIG. 5 is a screen page designed to help capture the image of the person.

According to the process, image capturing can be facilitated using a help screen page 50, illustrated in FIG. 5, comprising a zone 52 indicating the correct position of the face to be captured, a zone 54 illustrating the expression the player should preferably have on their face, and a zone 56 showing means acting as a timer counting down to the moment the image will be captured.

This screen page is preferably broadcast at the monitor 28*a* of the image capturing means.

Means are also provided for defining the image captured, in particular means suitable for cropping the image captured from the capture context, which can be operated and activated automatically, or manually by the person whose image is captured, or by a member of staff assisting with this operation.

Figure 8:
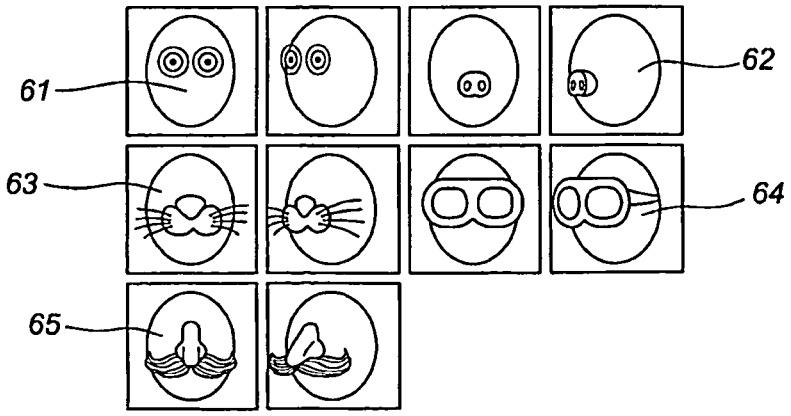
FIG. 8 shows a sequence of figurative images to be associated with the combined image.
Figure 9:
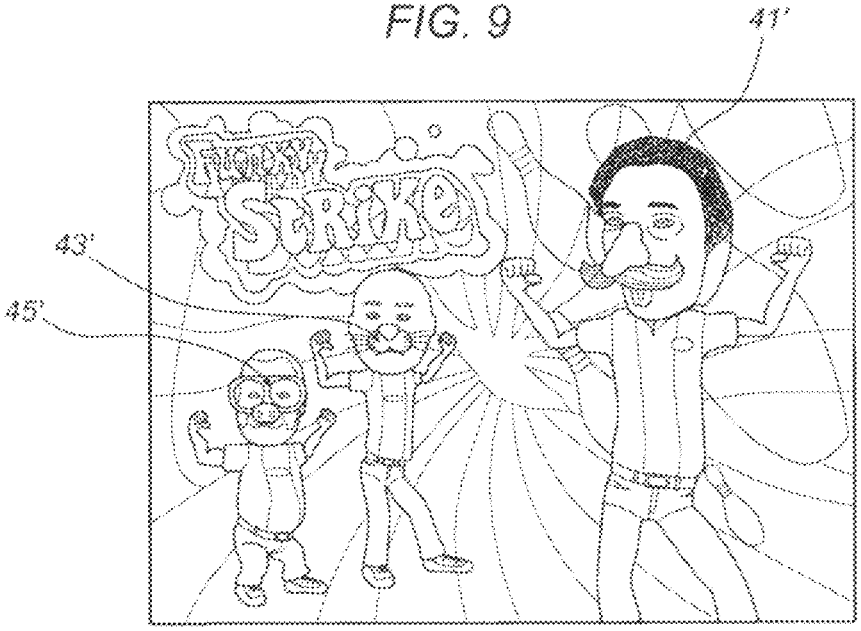
FIGS. 9 and 10 show corresponding examples of images to be broadcast at the lane.
Figure 10:
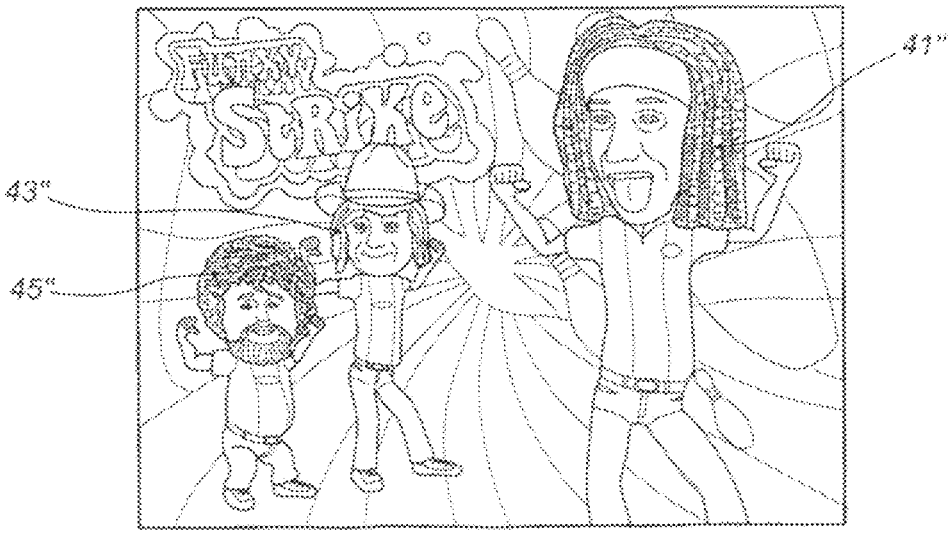

As may also be inferred from FIGS. 8 to 10, the basic images or the images of the person or images captured may also be modified or manipulated.

In practice, figurative elements, for example decorative elements, may be added to the image, in particular to the combined image.

In particular, as illustrated in FIG. 8, decorative elements may be added to the image of the person, in this way obtaining a combined image 44 in which the images captured are manipulated images 41' 43', 45' and 41", 43", 45", as illustrated in FIGS. 9 and 10.

In particular, there is a plurality of additional elements, labelled 61, 63, 64, 65 in FIG. 8. Said decorative images 61, 63, 64, 65 are in the form of respective fixed or static images.

Moreover, as an alternative to what is described above, this image editor may be used to add figurative elements to the basic image and/or the image of the person, said additional elements being designed to form an image corresponding to the characteristics of the person, for example able to define the age, gender, role, or other aspect of the person. For example, there would be figurative elements designed to define a female body, an adult male body or the body of a child or other.

This addition of figurative elements defining characteristics of the person therefore takes place during generation of the combined image to be associated with the specific player.

However, it shall be understood that the program or means for generating the combined images could, rather than being present at the monitor 28 of FIG. 2, be present at the central management means 26 or FRONT DESK.

Means may be provided, in the form of program routines or instructions, designed to transmit the image captured 41 to the central management means 26.

Moreover, according to another embodiment, the program or means for generating the combined images could be present at the local lane management means 36.

Whatever the case, the image is broadcast at the lane monitors 21, 22 by means of the lane management means 36, which comprise a program, or routine, and, by means of the local network 27, receive the image captured by the means 29, or receive the combined image to be displayed, from the generating means at the kiosk 28 or from the central management means 26. For this purpose, means are provided, in the form of program routines or instructions, for transmitting the image captured 41 or the combined image 44 to the central management means 36.

The stills camera 29 for capturing the image could be positioned, not just at a suitable point in the bowling alley, but also directly at the FRONT DESK or bowling alley central control point.

Therefore, briefly, according to a preferred embodiment, said means for generating the image to be displayed comprise image capturing means 29, means for facilitating image capture, means for defining the image captured, means for manipulating the image captured and means for creating the combined image, consisting of the image captured and the basic image, said means being in the form of respective program instructions.

An audio signal, for example a signal associated with the basic image 42, can also be associated with the video signal to be broadcast 44.

According to the process a video signal or combined image 44 to be broadcast is associated with a corresponding event, preferably a game event, for example a strike, a gutter, a win, reaching a predetermined score, so that it is broadcast after said game event occurs.

The operating program of the lane management means 36 also comprises corresponding routines or instructions forming means for causing the video signals 44 to be broadcast after the predetermined event occurs, for example after the sensor or detector means have detected the predetermined event at the bowling lane or after it has been determined by the score control program.

It shall be understood, however, that the functions of the lane control means might also be fully or partially implemented by the bowling centre's general control means 26 or by other control means at the bowling centre.

According to another viewpoint, the video signal to be broadcast 44 is associated with a corresponding player, then broadcast when a event relating to said player occurs. In practice, the lane management or SCORE means 36 can identify which player is playing, for example by means of the suitable entry of a corresponding data item using the input console 24 at the lane and have program routines or instructions designed to associate a respective video signal to be broadcast 44 with the corresponding player and means in the form of program routines or instructions for causing the related video signal 44 to be broadcast after an event relating to said player occurs.

According to the process illustrated, corresponding signals to be broadcast 44 are associated with a plurality of game events.

In practice, when a predetermined game event occurs, for example a particular game event, such as a strike, the apparatus according to the invention broadcasts a corresponding image which comprises the image of the player. In this way, the event and the person who produced the event are immediately brought to the attention of the other users, whether spectators or players, moreover all in a particularly entertaining and amusing way.

As shown in FIG. 2, according to another advantageous aspect, the animations or combined or customized images may be supplied to the person, preferably they can be saved on a respective medium 129, for example a CD-ROM, preferably using the PC of the kiosk used to capture the image of the person, as illustrated, or using suitable means at the FRONT DESK, then handed over to customers at the end of the game. According to another embodiment, customized images could also be sent to the user by e-mail.

According to another aspect, the images and the data relating to the person or the player could be entered in the system from outside the bowling centre, for example through an internet connection. In such a case, players may register using the bowling centre's web site, supplying data about the identity of the person and the characteristics required, that is to say the gender, age, role, etc. and they may also supply their own images, for example in the form of digital photographs, all at the time of booking the game.

According to another advantageous aspect, the images of the person may also be used for other identification purposes in the context of the bowling alley, preferably to identify players on the scoreboard, in place of or in addition to the names of the players.

Figure 11:
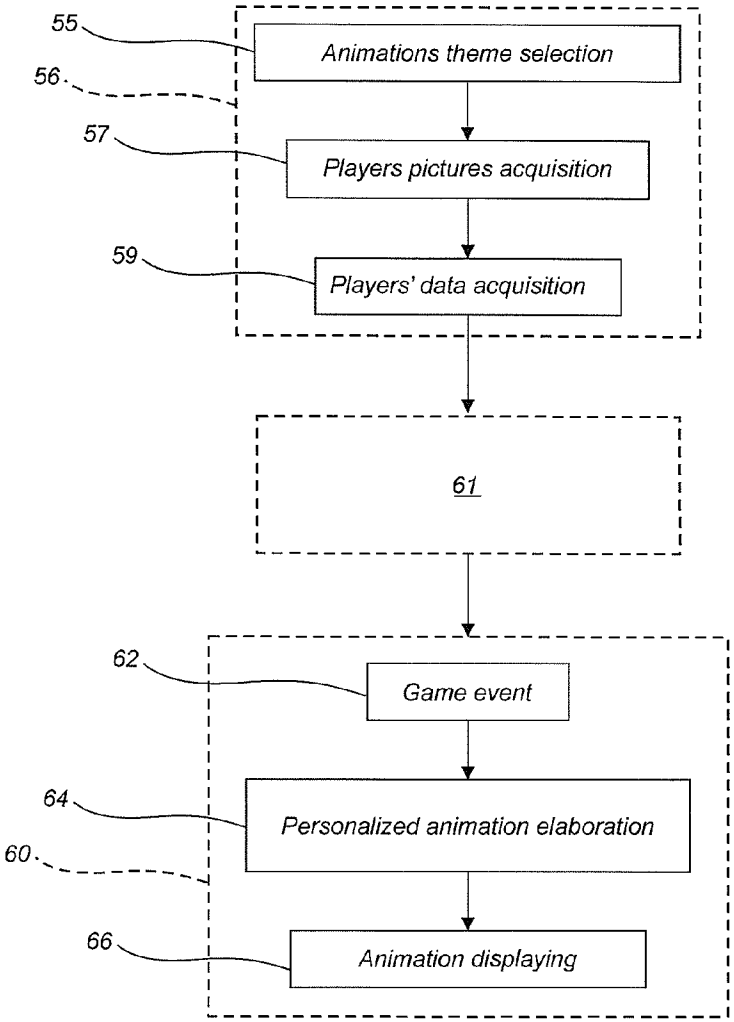
FIGS. 11 to 13 are diagrams representing the operations implemented by the present apparatus in accordance with the first preferred embodiment and controlled by a corresponding program.
Figure 13:
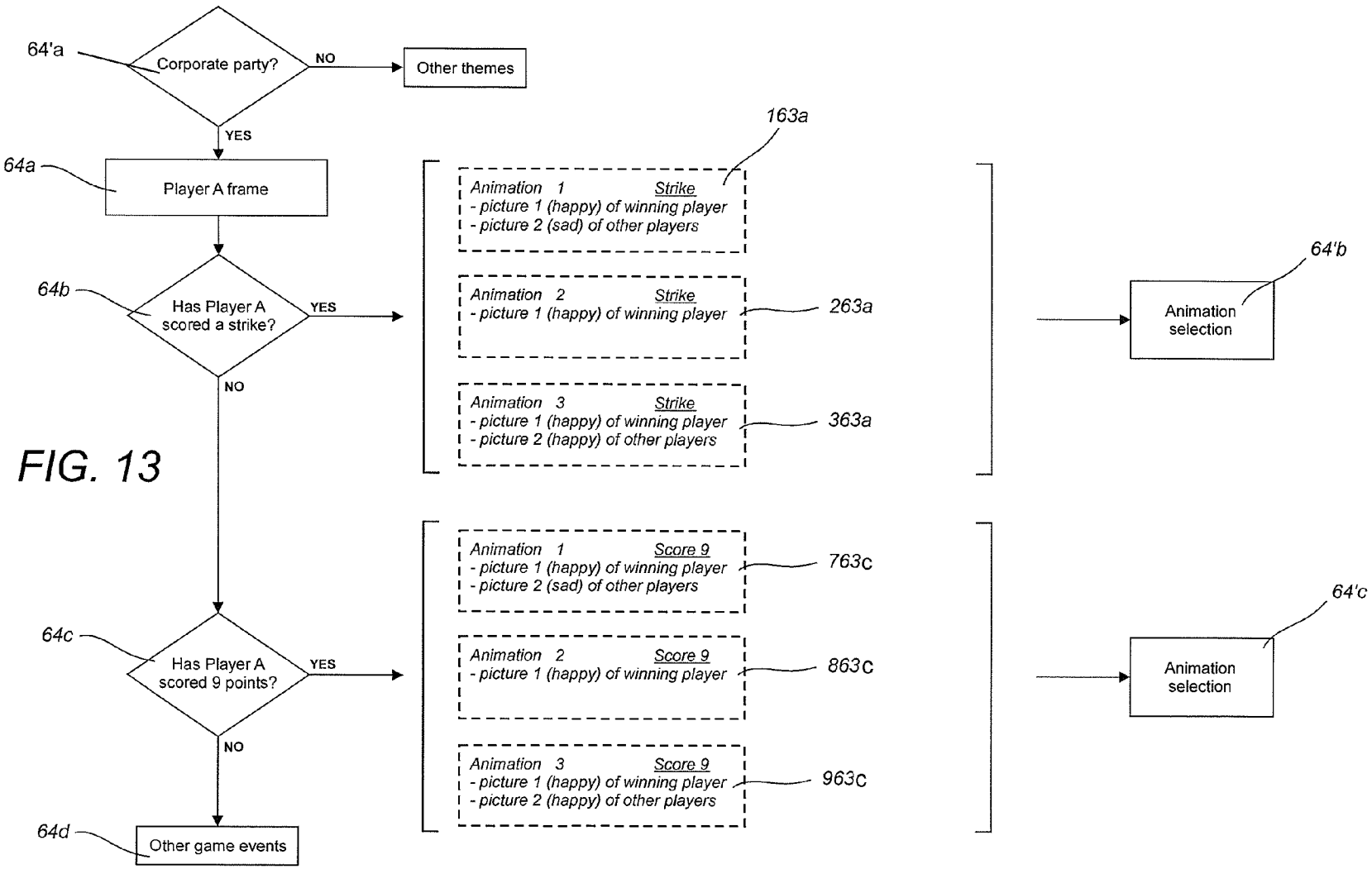

The apparatus according to the invention comprises means, in the form of a program with respective routines or instructions, for implementing the steps shown in FIGS. 11 to 13. In particular, as shown in FIG. 11, the step 55 of defining the signals to be displayed comprises, first, selecting the theme event, which might be a specific theme defining an occasion such as, for example, a company party, a birthday or other.

Then, the images of the players are acquired in 57, in particular a happy image, a sad image and a surprised image or a thoughtful image. In 59, player data is acquired, such as gender, age, role, for example office supervisor, the person celebrating their birthday, etc.

Then, in 61, as shown in FIG. 12, a respective set of combined or customized images is created, relating respectively to the specific player, to the specific theme or occasion and to the specific predetermined or game event.

As illustrated in FIG. 12, to obtain the specific images to be displayed during the game, one starts with a plurality of ready-made sets of basic animations, each set corresponding to a respective theme or occasion and, if necessary, to the respective characteristics of the player. For example, the set 63*a* could relate to a theme such as a company party and to an adult male whose role is office supervisor, whilst the set 63*b* could relate to the same office party and to an adult female whose role is that of secretary or assistant.

As shown by way of example, each set of basic images has a plurality of default images, for example the set 63*a* comprises the basic images 163*a*, 263*a*, 363*a*, 463*a*, 563*a*, 663*a* and any others. A similar case applies for all of the other sets 63*b*, 63*c*, 63*d* and any others.

As indicated by the block 65, according to the present preferred process, a corresponding image of the person, already arranged relative to the basic image, is associated with the respective basic image.

Then, in 67 the combined image created in this way is displayed and, if approved, the combined or customized image generated in this way is saved in 69.

The combined image generation sequence is repeated for each basic image in the selected set, for example, for each basic image 163*a*, 263*a*, 363*a*, 463*a*, 563*a*, 663*a* and any others. The combined image generation sequence is also repeated for each player or person 159, 259, 359 and for any other persons.

Then, as illustrated in FIG. 11, in a subsequent step, for example of playing the game 60, in 62 a corresponding predetermined event relating to a respective player is detected, and in 64 the system selects a corresponding combined image.

For this purpose, as shown in FIG. 13, the step 64 of selecting the combined image, after determining in 64'*a* whether or not a specific theme such as the company party has been selected, involves, in 64*a*, acquisition of the data item for the player who is playing, generating a data item relating to a game event, comparing, in 64*b*, the data item relating to the game event in progress with a data item corresponding to the predetermined event, in particular relating to a strike. If the check proves true, a predetermined rule is used for the selection in 64'*b* of a corresponding combined image 163*a*, 263*a*, or 363*a*, to be broadcast in accordance with a predetermined rule.

If the check proves false, in 64*c* there is a subsequent comparison between the data item acquired for the event in progress and another data item corresponding to a predetermined event, in particular which could relate to reaching a score of "9" points. If this check proves true, a predetermined rule is used for the selection in 64'*c* of a corresponding combined image 763*a*, 863*a*, or 963*a* to be broadcast. If the check proves false, in 64*d* there are subsequent comparisons similar to that just described. In practice, the program proceeds until an image corresponding to the predetermined event is broadcast.

In accordance with an advantageous aspect of the present process and apparatus, it is therefore possible to use the images, in particular the photographs, of players to create video animations with a direct link both to the game events and to the players present on the lane.

The combined images or customized animations are obtained by processing basic animations and photographs of the players present on the lane.

In particular, this processing involves placing photographs of the players on predetermined basic animations. This is done according to predetermined rules, associated with each animation, which indicate how the images must be combined. Said method of combining the images is such that it creates a link between the game event and the players, in particular between the players taking part in the same game, and if necessary between players playing different games.

Moreover, the situations represented by the animations subsequently displayed have a meaning relative to the game in progress. For example, from images shown one after another, it is possible to infer whether or not the player is winning or losing.

The way the game is going is shown by the score of the players playing the same game. The customized animations may be such that they represent situations which, according to current standards and customary behaviour, are examples of various player moods.

In a predetermined way, said customized animations are associated with corresponding play situations, which when they occur one after another lead to the broadcasting of corresponding customized or combined images, having a meaning relative to the game in progress.

For example, at the start of the game the strike animation may, for all of the players, feature as the jubilant character the one with the face of the player who recorded the strike, with the other characters having the faces of the other players, who are instead crying.

When, during the game, the players' scores indicate that the game will potentially be won only by two of the players present, the strike animations of these two players will change, with the leader jubilant, the direct adversary looking unhappy, and the other players as supporters. Obviously, other relative embodiments are possible.

In this way, the animations displayed have a meaning, determined by game events and the characteristics of the players, which shows the relationships between the players, immediately making clear the relationship between the players in the specific context, in particular in the context of the game. All of this leads to greater involvement of the players and the public, thanks to the presence on the monitor of the faces of the characters directly involved in the game, in the context of situations which are always different and greatly customized.

The themes corresponding to occasions could, for example, be such as to represent a company party, a children's birthday party, a birthday party for adults, and so on.

In accordance with another aspect of the present process, the combined images are broadcast not just at the lane monitors 21, 22, but also at the main bowling alley monitors 23.

According to another advantageous aspect, the images of persons playing at one bowling alley may be broadcast at another bowling alley.

For this purpose, images of the persons to be broadcast are exchanged between one bowling alley and another.

Signals relating to the occurrence of game events may also be exchanged between one bowling alley and another.

In particular, the combined images created at one bowling alley may be broadcast at another bowling alley.

In practice, an Internet connection will be used to make images of persons available, in particular combined images, in different bowling alleys, for example located in different towns.

In this way, players at one bowling alley could play against players at another bowling alley, or they could be informed of how a game is going for players playing at the other bowling alley.

For this purpose, there are connecting means designed to receive and send data or signals, in particular video signals, from another or other bowling alleys or bowling centres.

Said connecting means are able to exchange signals relative to the image processed to be broadcast at said bowling alley, that is to say, they are able to exchange signals and/or data relative to the player, or players, for whom the above-mentioned method will be used to create a combined image at the respective bowling alley.

Therefore, there are also means designed to broadcast, in particular at a respective lane, at least one corresponding video signal, after receiving said video signal from another bowling alley, or means designed to broadcast a video signal in the form of a combined image created at the same bowling alley, after receiving a signal or data item corresponding to an event recorded at the other bowling alley.

The connection between the bowling alleys may be made using the global communication network, or Internet, using the web sites of the various bowling alleys, or in any other suitable way.

In particular, video signals may be created which comprise the image of persons located, and in particular playing, at different bowling alleys.

These methods of broadcasting video images are used to produce shared events at two or more bowling alleys. For example, a tournament could be held between the persons of different branches of a company located in different towns, without said persons having to go directly to the same bowling alley.

Figure 14:
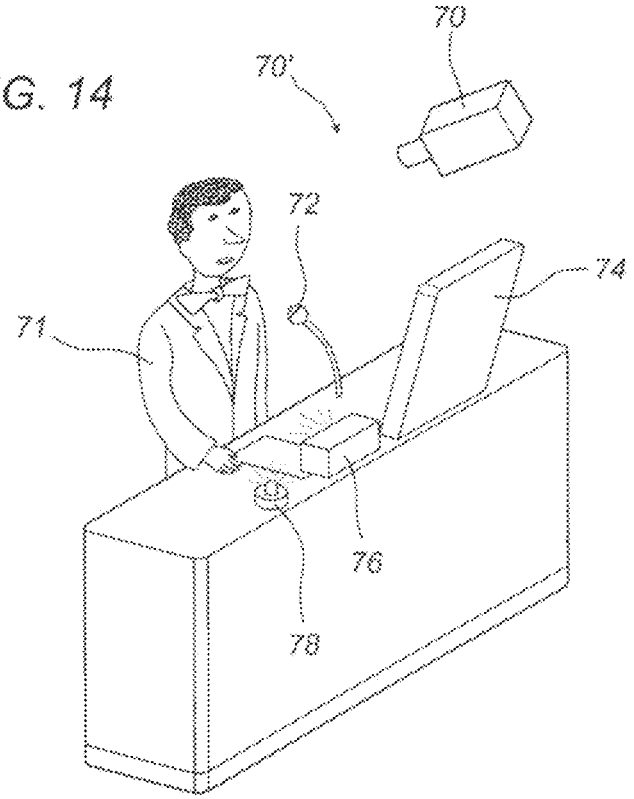
FIG. 14 is a schematic perspective view, representing the service point, in particular a bar service point, relative to a second preferred procedure for managing signals to be broadcast at a bowling alley.
Figure 15:
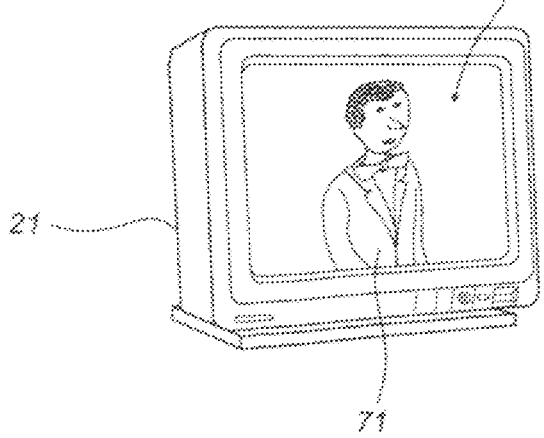
FIG. 15 is a schematic perspective view of the lane monitor, whilst it displays the streamvideo image captured at the bar service point, in accordance with the second preferred procedure for managing the signal to be broadcast.

FIGS. 14 and 15 show aspects of a second preferred embodiment of the process for managing signals to be broadcast at a bowling alley or the like.

In accordance with this second embodiment, an image 73 is captured which is displayed at a lane display, in particular as illustrated in FIG. 15 by the display or monitor at the player point 21.

In accordance with this embodiment, an animated image 73 is broadcast at the display 21, the image captured by a video camera 70, which captures the image of an operator at a respective bowling alley service point, in particular an operator at a bar service point 70'.

In this way, an image is defined in the form of an animation, produced by capturing the image of the operator at said bar point.

Advantageously, the video camera 70 used for capturing the image is connected, in particular by the local network 27, to the lane management means 36.

According to the process, a call signal from the player at the lane is also broadcast, preferably created using the input means 24, at the lane, and transmitted through the lane management means 36 and the local network 27 to corresponding broadcasting means, in particular in the form of a loudspeaker 76 and a LED 78, at the bar point 70'. Therefore, said call signal comprises an audio signal broadcast by the loudspeaker 76.

The signal broadcast at the lane in turn comprises an audio signal corresponding to the voice of the person whose image is captured, picked up by a microphone 72, at the point 70', then broadcast by a corresponding loudspeaker 76 at the lane.

In this way, it is possible to place orders at the bar in a way that is extremely advantageous for players, who can check whether the staff concerned have effectively received their orders and can communicate with them in an informal, rapid fashion.

There may also be a monitor 74 used by the operator 71 at the bar point, and means 75 for connection to the network 27.

The animated image 73 shown in FIG. 15 and displayed at the lane monitor 21 therefore comprises the actual image of the operator 71 at the bar point.

The invention described above is susceptible of industrial application and may be modified and adapted in several ways without thereby departing from the scope of the inventive concept. Moreover, all the details of the invention may be substituted by technically equivalent elements.

The invention claimed is:

1. A process for managing signals at a bowling centre, where a signal is broadcast, which comprises a video signal broadcast by a computing device, the video signal including an image of at least one player, wherein:

ready-made sets of basic animations corresponding to a theme or occasion is provided, the image of the at least one player is acquired by the bowling centre, the image of the at least one player includes at least one mood of the at least one player, the image of the at least one player is combined with a basic image of the basic animations when a predetermined event occurs in order to create a customized image of the at least one player, the image of the at least one player, which encompasses the at least one mood, is selected based on the event that has occurred at the bowling centre, the predetermined event relates to a game of the bowling centre, wherein the signal including the image of the at least one player combined with the basic image to form the customized image is broadcast in connection with-an activity occurring at the bowling centre, the signal which comprises a video signal includes the customized image of the at least one player, wherein:

the video signal includes static images of the at least one player and the basic image, the basic image comprises a predetermined character with which the image of the at least one player is associated and a background defined by a respective theme or occasion, the static images of the at least one player corresponds to at least two static images of the person's face showing that least one mood, the predetermined character comprises a fixed part and at least one animated part, and the at least two static images of the person's face is connected with the predetermined character such that the at least one player appears to be moving based on the at least one animated part of the predetermined character.

2. The process according to claim 1, wherein a plurality of predetermined events are designed to cause the signal including the image of the at least one player to be broadcast.

3. The process according to claim 1, wherein the signal including the image of the at least one player is broadcast automatically upon occurrence of the predetermined event.

4. The process according to claim 1, wherein the video signal is broadcast at the respective lane.

5. The process according to claim 1, wherein the basic image comprises an alphanumeric string indicating a corresponding event.

6. The process according to claim 1, wherein the image of the at least one player is captured at a bowling alley.

7. The process according to claim 1, wherein the image of the at least one player is captured outside a bowling alley.

8. The process according to claim 1, wherein the predetermined character comprises a stylized body with fixed parts and an animated part.

9. The process according to claim 1, wherein a plurality of images of a single person are captured.

10. The process according to claim 9, wherein the captured images correspond to the person's different facial expressions.

11. The process according to claim 1, wherein the predetermined character comprises a person's face attached to the basic image.

12. The process according to claim 11, further comprising obtaining data identifying the at least one player and data about specific characteristics of the at least one player, wherein the data identifying the person gender, age and role.

13. The process according to claim 12, further comprising associating the data identifying the at least one player and data about specific characteristics.

14. The process according to claim 13, further comprising identifying a specific theme or occasion, and automatically selecting the specific theme or occasion to be associated with the image of the at least one player or corresponding to the specific theme or occasion.

15. A process for managing signals at a bowling centre, where a signal is broadcast, which comprises a video signal broadcast by a computing device, the video signal including an image of at least one player, wherein:

ready-made sets of basic animations corresponding to a theme or occasion is provided, the image of the at least one player is acquired by the bowling centre, the image of the at least one player includes at least one mood of the at least one player, the image of the at least one player is combined with a basic image of the basic animations when a predetermined event occurs in order to create a customized image of the at least one player, the image comprises the image of the at least one player connected with the event that has occurred at the bowling centre, the predetermined event relates to a game of the bowling centre, the signal including the image of the at least one player combined with the basic image is broadcast to form the customized image in connection with a bowler playing at a respective lane, the signal which comprises a video signal includes a static image of the at least one player and the basic image which comprises at least a background theme and a character comprising a fixed part and at least one animated part to form the customized image of the at least one player, the at least one player is connected with the character such that the at least one player appears to be moving based on the at least one animated part of the character, and the video signal comprises the images of a plurality of persons, and the signal which comprises the video signal includes a combined image of the persons and the basic image and the predetermined character comprises a fixed part and at least one animated part.

16. The process according to claim 15, wherein the basic image comprises an alphanumeric string indicating a corresponding event.

17. The process according to claim 15, wherein the image of the respective persons corresponds to the person's face.

18. A process for managing signals at a bowling centre, where a signal is broadcast , which comprises a video signal broadcast by a computing device, which includes an image of at least one player, wherein:

ready-made sets of basic animations corresponding to a theme or occasion is provided, the image of the at least one player is acquired by the bowling centre, the image of the at least one player includes at least one mood of the at least one player, the image of the at least one player is combined with a basic image of the basic animations when a predetermined event occurs in order to create a customized image of the at least one player, and comprises the image of the at least one player connected with the event that has occurred at the bowling centre, the predetermined event relates to a game of the bowling centre, the signal including the image of the at least one player combined with the basic image to form the customized image is broadcast in connection with a bowler playing at a respective lane, the signal which comprises a video signal includes static images of the at least one player and the basic image comprising at least a background theme and a character comprising a fixed part and at least one animated part which creates the customized image of the at least one player, wherein respective pluralities of basic images are used, a respective plurality of basic images corresponds to each other to define a common background theme, and each basic image of a plurality of basic images corresponding to a respective theme is associated with a corresponding predetermined event.

19. The process according to claim 18, wherein many basic images of the plurality of basic images corresponding to a respective theme are associated with a single predetermined event.

20. The process according to claim 18, wherein different sets of basic images corresponding to a respective theme are used.

21. The process according to claim 18, wherein the images in the respective pluralities of basic images corresponding to a respective theme have in common at least one graphic or significant element identifying a respective theme.

22. A process for managing signals at a bowling centre, where a signal is broadcast by a computing device, which comprises a video signal including an image of at least one player, wherein:

ready-made sets of basic animations corresponding to a theme or occasion is provided, the image of the at least one player is acquired by the bowling centre, the image of the at least one player includes at least one mood of the at least one player, the image of the at least one player is combined with a basic image of the basic animations when a predetermined event occurs in order to create a customized image of the at least one player, and comprises the image of the at least one player connected with the event that has occurred at the bowling centre, the predetermined event relates to a game of the bowling centre, the signal including the image of the at least one player combined with the basic image to form the customized image is broadcast in connection with an activity of a bowler playing at a respective lane, the signal which comprises a video signal includes a static image of the at least one player and the basic image to form the customized image of the at least one player, a plurality of static images of a single at least one player are captured, and wherein the captured static images correspond to the at least one player's different facial expressions, displaying the captured static images of the single at least one player and the basic image based on the predetermined event, and the captured images are selected in such a way that they correspond to a predetermined state of the at least one player, in particular a mood.

23. The process according to claim 22, wherein the image of the at least one player is captured at a bowling alley.

24. The process according to claim 22, wherein the captured images correspond to a smiling expression, a surprised expression and a sad expression.

25. The process according to claim 22, further comprising manipulating the image of the at least one player to be displayed.

26. The process according to claim 25, wherein the manipulating the image of the at least one player comprises adding figurative elements to the image of the person.

* * * * *